US007900720B2

(12) United States Patent
Hall et al.

(10) Patent No.: US 7,900,720 B2
(45) Date of Patent: Mar. 8, 2011

(54) DOWNHOLE DRIVE SHAFT CONNECTION

(75) Inventors: David R. Hall, Provo, UT (US); David Lundgreen, Provo, UT (US); Paula Turner, Pleasant Grove, UT (US); Daryl Wise, Provo, UT (US); Nathan Nelson, Provo, UT (US); Andrew Pilgrim, Provo, UT (US); Robert Myler, St. Louis, MO (US)

(73) Assignee: Schlumberger Technology Corporation, Houston, TX (US)

( * ) Notice: Subject to any disclaimer, the term of this patent is extended or adjusted under 35 U.S.C. 154(b) by 20 days.

(21) Appl. No.: 11/956,623

(22) Filed: Dec. 14, 2007

(65) Prior Publication Data

US 2009/0152011 A1 Jun. 18, 2009

Related U.S. Application Data

(63) Continuation-in-part of application No. 11/306,976, filed on Jan. 18, 2006, now Pat. No. 7,360,610.

(51) Int. Cl.
*E21B 7/08* (2006.01)
*E21B 10/36* (2006.01)

(52) U.S. Cl. ..... 175/325.2; 175/425

(58) Field of Classification Search ..... 175/51, 175/415, 293, 389, 320, 325.2, 73
See application file for complete search history.

(56) References Cited

U.S. PATENT DOCUMENTS 616,118 A 12/1889 Kunhe
485,103 A 12/1891 Wegner
946,060 A 1/1910 Looker
1,116,154 A 11/1914 Stowers
1,183,630 A 5/1916 Bryson
1,169,560 A 7/1916 Gondos
1,360,908 A 11/1920 Everson
1,387,733 A 8/1921 Midgett
1,460,671 A 7/1923 Hebsacker
1,544,757 A 7/1925 Hufford
1,821,474 A 6/1931 Mercer
2,169,223 A 8/1931 Christian
1,879,177 A 9/1932 Gault
2,054,255 A 9/1936 Howard
2,064,255 A 12/1936 Garfield
2,218,130 A 10/1940 Court
2,320,136 A 5/1943 Kammerer
2,466,991 A 4/1949 Kammerer
2,540,454 A 2/1951 Stokes
2,544,036 A 3/1951 Kammerer
2,755,071 A 7/1956 Kammerer
(Continued)

*Primary Examiner* — Kenneth Thompson
*Assistant Examiner* — James G Sayre
(74) *Attorney, Agent, or Firm* — Holme Roberts & Owen LLP

(57) ABSTRACT

In one aspect of the present invention, a section of a drill string has a drill bit with a body intermediate a shank and a working face, the working face having at least one cutting element. A jack element is disposed within the drill bit body and has a distal end substantially protruding from the working face. A drive shaft is in communication with the jack element and a rotary source. The drive shaft has a first portion secured within a bore of a tool string component in the tool string and a second portion secured within a bore of the drill bit. The first and second portions of the drive shaft are connected at a pin and box connection wherein the first and second portions are automatically connected as the tool string component is mechanically coupled to the drill bit.

17 Claims, 8 Drawing Sheets

U.S. PATENT DOCUMENTS 2,776,819 A 1/1957 Brown
2,819,043 A 1/1958 Henderson
2,838,284 A 6/1958 Austin
2,894,722 A 7/1959 Buttoiph
2,901,223 A 8/1959 Scott
2,963,102 A 12/1960 Smith
3,135,341 A 6/1964 Ritter
3,294,186 A 12/1966 Buell
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summers
4,109,737 A 8/1978 Bovenkerk
4,176,723 A 12/1979 Arceneaux
4,253,533 A 3/1981 Baker, III
4,280,573 A 7/1981 Sudnishnikov et al.
4,304,312 A 12/1981 Larsson
4,307,786 A 12/1981 Evans
4,397,361 A 8/1983 Langford
4,416,339 A 11/1983 Baker et al.
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story et al.
4,574,895 A 3/1986 Dolezal
4,640,374 A 2/1987 Dennis
4,852,672 A 8/1989 Behrens
4,889,017 A 12/1989 Fuller et al.
4,962,822 A 10/1990 Pascale
4,981,184 A 1/1991 Knowlton et al.
5,009,273 A 4/1991 Grabinski
5,027,914 A 7/1991 Wilson
5,038,873 A 8/1991 Jurgens
5,119,892 A 6/1992 Clegg et al.
5,141,063 A 8/1992 Quesenbury
5,186,268 A 2/1993 Clegg
5,222,566 A 6/1993 Taylor
5,255,749 A 10/1993 Bumpurs
5,265,682 A * 11/1993 Russell et al. ..... 175/45
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,848,657 A 12/1998 Flood
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,978,644 A 11/1999 Sato et al.
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong et al.
6,186,251 B1 2/2001 Butcher
6,202,761 B1 3/2001 Forney
6,213,226 B1 4/2001 Eppink
6,223,824 B1 5/2001 Moyes
6,253,864 B1 7/2001 Hall
6,269,069 B1 7/2001 Ishida et al.
6,269,893 B1 8/2001 Beaton
6,332,503 B1 12/2001 Pessier et al.
6,340,064 B2 1/2002 Fielder
6,364,034 B1 4/2002 Schoeffler
6,394,200 B1 5/2002 Watson
6,408,959 B2 6/2002 Bertagnolli
6,439,326 B1 8/2002 Huang et al.
6,474,425 B1 11/2002 Truax
6,484,825 B2 11/2002 Watson et al.
6,484,826 B1 11/2002 Anderson
6,510,906 B1 1/2003 Richert et al.
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey et al.
6,668,949 B1 12/2003 Rives
6,672,406 B2 1/2004 Beuershausen
6,729,420 B2 5/2004 Mensa-Wilmot
6,732,817 B2 5/2004 Dewey et al.
6,822,579 B2 11/2004 Goswami
6,929,076 B2 8/2005 Fanuel
6,953,096 B2 10/2005 Gledhill
3,301,339 A1 9/2006 Pennebaker
7,104,345 B2 * 9/2006 Eppink ..... 175/61
7,207,398 B2 * 4/2007 Runia et al. ..... 175/61
7,571,780 B2 * 8/2009 Hall et al. ..... 175/385
2001/0004946 A1 6/2001 Jensen
2003/0213621 A1 11/2003 Britten
2004/0238221 A1 12/2004 Runia
2004/0256155 A1 12/2004 Kriesels
2006/0283636 A1 * 12/2006 Reagan ..... 175/107
2008/0156536 A1 * 7/2008 Hall et al. ..... 175/57

* cited by examiner

DOWNHOLE DRIVE SHAFT CONNECTION

CROSS REFERENCE TO RELATED APPLICATIONS

This application is a continuation in-part of U.S. patent application Ser. No. 11/306,976, filed Jan. 18, 2006, now U.S. Pat. No. 7,360,610. This application in herein incorporated by reference for all that it contains.

BACKGROUND OF THE INVENTION

This invention relates to drill bits, specifically drill bit assemblies for use in oil, gas and geothermal drilling. Drill bits are continuously exposed to harsh conditions during drilling operations in the earth's strata. Bit whirl in hard formations for example may result in damage to the drill bit and reduce penetration rates. Further loading too much weight on the drill bit when drilling through a hard formation may exceed the bit's capabilities and also result in damage. Too often unexpected hard formations are encountered suddenly; and damage to the drill bit occurs before the weight on the drill bit may be adjusted. When a bit fails, it reduces productivity resulting in diminished returns to a point where it may become uneconomical to continue drilling. The cost of the bit is not considered so much as the associated down time required to maintain or replace a worn or expired bit. To replace a bit requires removal of the drill string from the bore in order to service the bit which translates into significant economic losses until drilling can be resumed.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon. Sinor seeks to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The model is reduced to retain only pertinent modes. At least two values, Rf and Rwob, are calculated. Rf a function of the principal oscillation frequency of weight on hook (who) divided by the average instantaneous rotating speed at the surface. Rwob is a function of the standard deviation of the signal of the weight on bit (WOB) estimated by the reduced longitudinal model from measurement of the signal of the weight on hook (WOH), divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a down hole sensor sub in the lower end of a drillstring. The sub has three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

A section of a drill string has a drill bit with a body intermediate a shank and a working face. The working face at least one cutting element. A jack element is disposed within the drill bit body and has a distal end substantially protruding from the working face. A drive shaft is in communication with the jack element and a source of rotational power. The drive shaft has a first portion secured within a bore of a tool string component in the tool string and a second portion secured within a bore of the drill bit. The first and second portions of the drive shaft are connected at a pin and box connection wherein the first and second portions are automatically connected as the tool string component is mechanically coupled to the drill bit.

The connection of the first and second portions may a sleeve that has an internal shape with an at least one external feature to interlock either the first or second portion, or both. The at least one feature may be selected from the group consisting of splines, threads, keys, polygonal (in section) surfaces, elliptical (in section) surfaces, or combinations thereof.

The connection may be a threaded connection. The connection may comprise a guide. The connection may comprise a bore adapted to receive the guide. The guide may comprise a geometry selected from the group consisting of splines, keys, polygonal surfaces or combinations thereof.

The drive shaft and jack element may advance the drill string further into a formation by rotating. The drive shaft and jack element assist in advancing the drill string further into the formation by oscillating back and forth with respect to the formation.

The pin and box connection may comprise a press-fit. The first portion may be press-fit into the sleeve. The second portion may be press-fit into the sleeve. The first portion may comprise a material selected from the group consisting of cemented metal carbide, steel, manganese, nickel, chromium, titanium, or combinations thereof. The second portion may comprise a material selected from the group consisting of cemented metal carbide, steel, manganese, nickel, chromium, titanium, or combinations thereof.

The second portion may comprise a generally conical region The at least one feature may have a length of 2.5 inches to 3.75 inches. The at least one feature may have a length of 3 inches.

The first portion and the second portion may comprise at least one coating. The at least one coating may comprise a material selected from the group consisting of a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof. The first portion and the second portion may comprise a cemented metal carbide distal end.

DETAILED DESCRIPTION OF THE INVENTION AND THE PREFERRED EMBODIMENT

Figure 1:
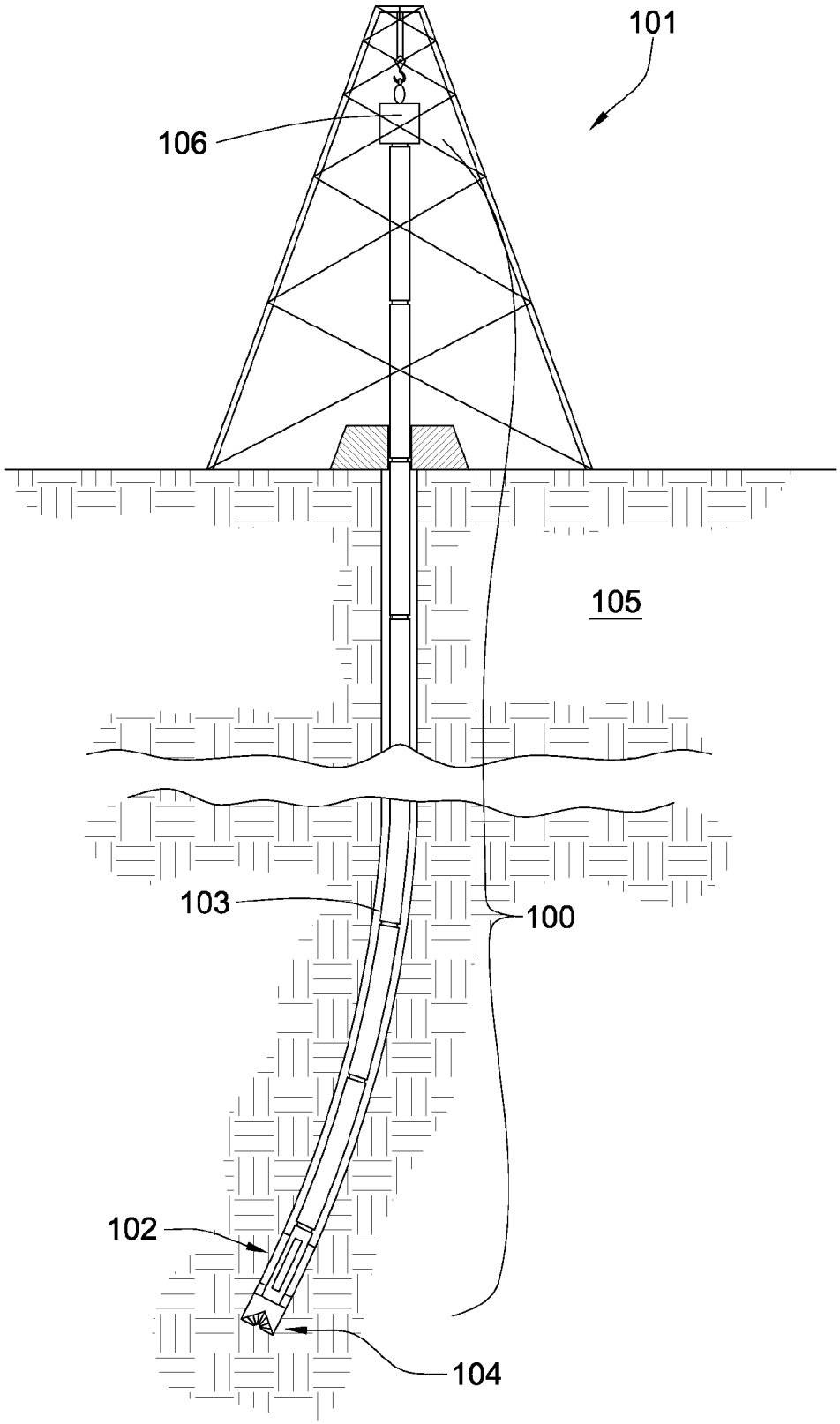
FIG. 1 is a perspective diagram of an embodiment of a drill string suspended in a bore hole.

FIG. 1 is a perspective diagram of an embodiment of a drill string 100 suspended by a derrick 101. A bottom-hole assembly 102 is located at the bottom of a wellbore 103 and includes a drill bit 104. As the drill bit 104 rotates downhole, the drill string 100 advances farther into the subterranean formations. The drill string 100 may penetrate soft or hard subterranean formations 105. The drill bit 104 may be adapted to steer the drill string 100 in a desired trajectory. Steering may be controlled by rotating a jack element (see FIG. 2) that is disposed at least partially within the drill bit 104 around a central axis of the jack element. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string 100.

Figure 2:
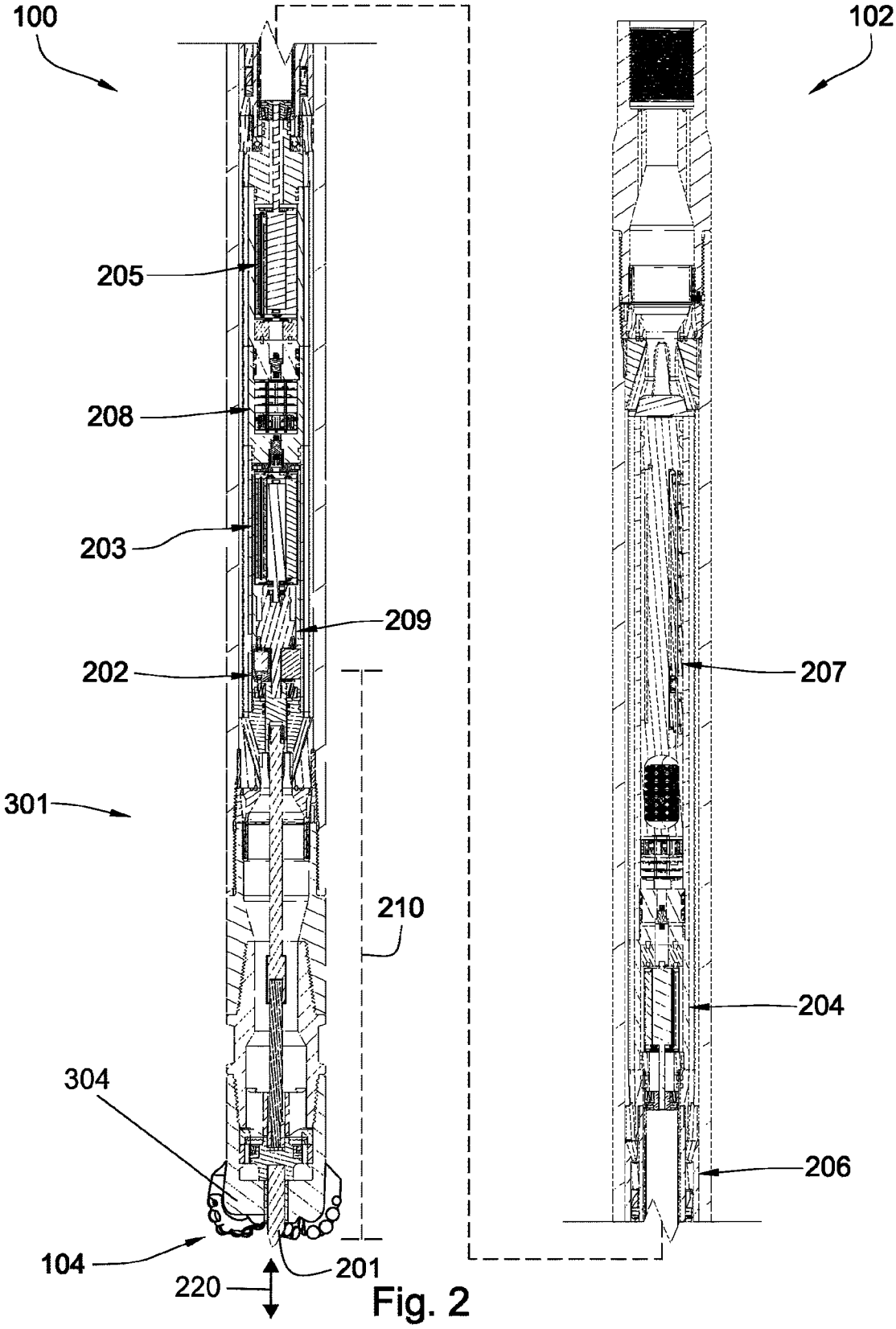
FIG. 2 is a cross-sectional diagram of an embodiment of a drill string.

Referring now to FIG. 2, a cross-sectional diagram of a portion of the drill string 100 shows a bottom-hole assembly (BRA) 102. The drill bit 104 may be part of the BRA 102 and which includes a jack element 201. The jack element 201 may oscillate towards and away from the formation 105 and/or the jack element 201 may rotate with respect to the drill bit body 304. The drill string 100 may comprise at least one position feedback sensor 202 that is adapted to detect a position and/or orientation of the jack element 201. Monitoring the position and/or orientation of the jack element 201 may aid in steering the drill string 100. Rotation of the jack element 201 may be powered by a rotary source, such as a downhole motor 203. The downhole motor 203 may be an electric motor, a mud motor, or combinations thereof. In some embodiments, drill string 100 includes an upper generator 204 and a lower generator 205. Both generators 204, 205 are powered by the flow of drilling mud (not shown) past one or more turbines 206 disposed intermediate the two generators 204, 205. In some embodiments only one generator may be used, and in other embodiments another method of powering the motor 203 may be employed.

The upper generator 204 may provide electricity to a direction and inclination (D&I) package 207. D&I package 207 may monitor the orientation of the BHA 102 with respect to some object, such as the center of the planet, the moon, the surface of the planet, a satellite, or combinations thereof. The lower generator 205 may provide electrical power to a computational board 208 and to the motor 203. The computational board 208 may control steering and/or motor functions. The computational board 208 may receive drill string orientation information from the D&I package 207 and may alter the speed or direction of the motor 203.

In some embodiments a tool string component 301 is disposed in a terminal section 210 of the drill string 100 and may be adapted to rotate with respect to the drill string 100 while the motor 203 may be rotationally fixed to the drill string 100. In some embodiments one or more motor like motor 203, generators 204, 205, computational boards 208, D&I package 207, or some other electrical component, may be rotationally isolated from the drill string 100.

In some embodiments, the motor 203 connects to the jack element 201 via a gear train 209. The gear train 209 may couple rotation of the motor 203 to rotation of the jack element 201 at a ratio of 25 rotations to 1 rotation and may itself be rotationally fixed to the drill string 100. In some embodiments a different ratio may be used, such as, but not limited to 15-30 rotations to 1 rotation. The gear train 209 and the jack element 201 may be part of the tool string component 301.

Figure 3:
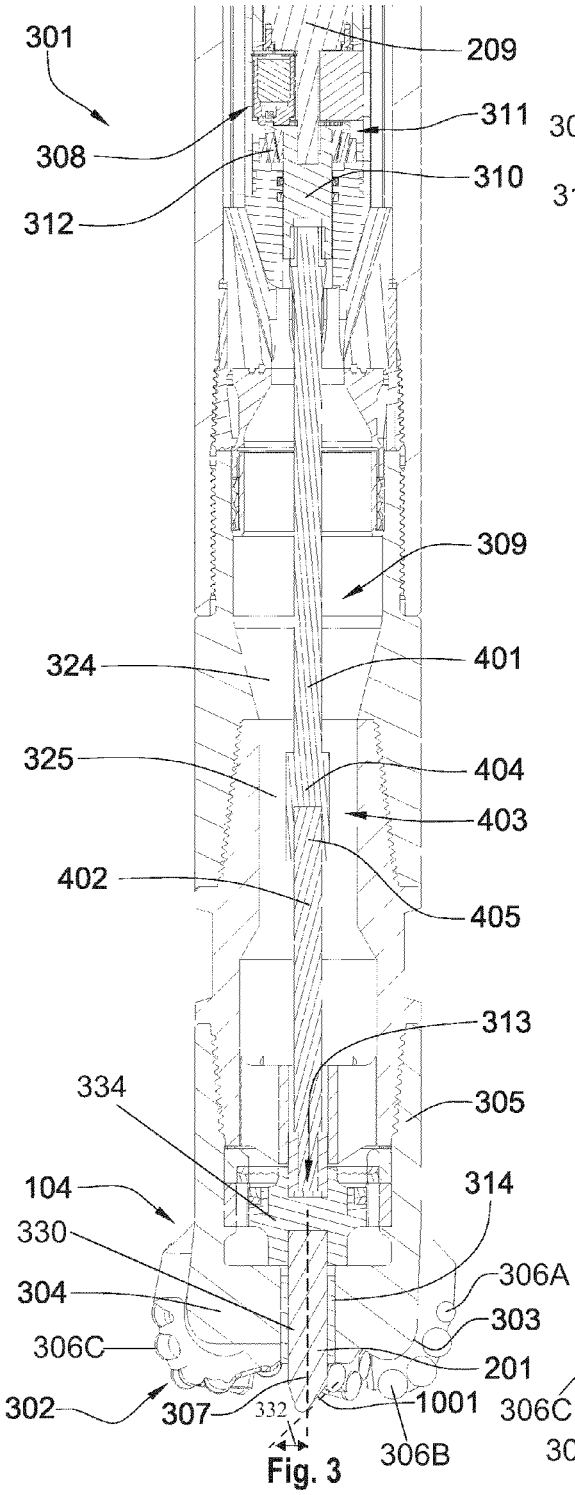
FIG. 3 is a cross-sectional diagram of an embodiment of a section of a drill string.
Figure 4:
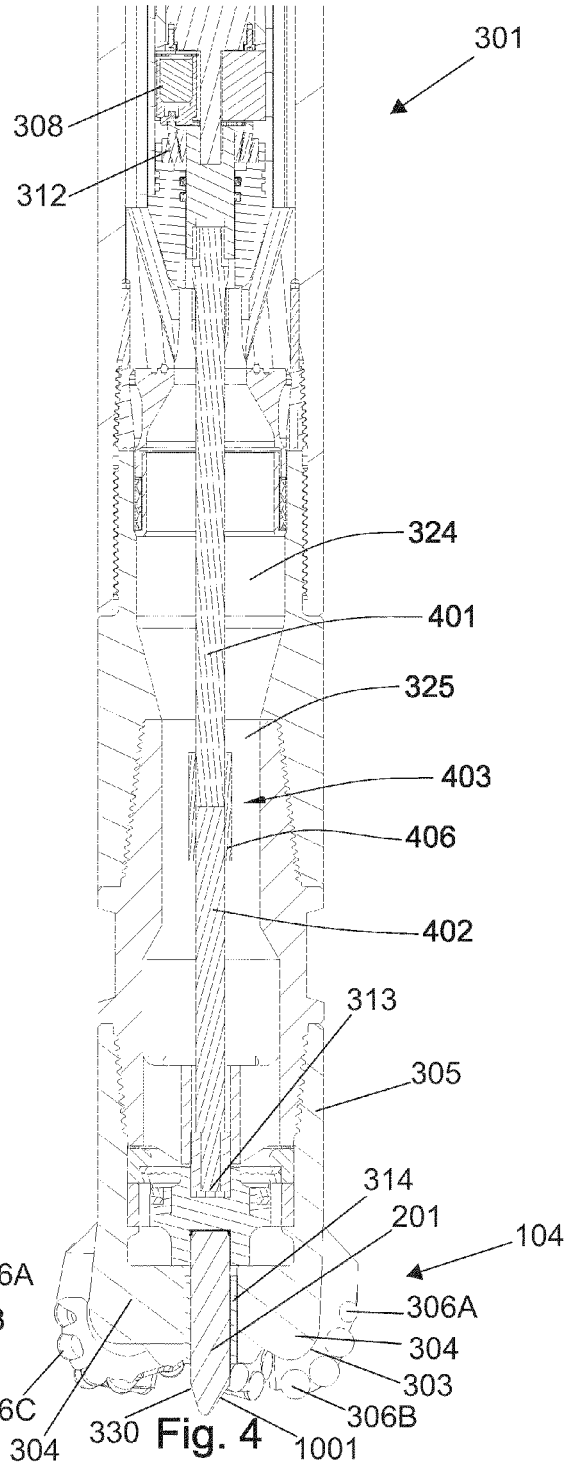
FIG. 4 is a cross-sectional diagram of another embodiment of a section of a drill string.

FIGS. 3 through 4 are cross-sectional diagrams of embodiments of portions of the tool string component 301. The tool string component 301 is part of the drill string 100 (FIG. 1)

and may be disposed within the BRA 102. The tool string component 301 has a bore 324 adapted to house at least one component of the tool string component 301. The jack element 201 is disposed on a distal end 302 of tool string component 301; and the jack element 201 substantially protrudes from a working face 303 of the drill bit 104, and is adapted to move with respect to the bit body 304 of the bit 104. The bit body 304 is disposed intermediate a shank 305 and the working face 303. The bit body 304 has a bore 325 formed in it. The working face 303 has at least one cutting element 306. In some embodiments the working face comprises a plurality of cutting elements like element 306A-C. The drill bit 104 may advance the drill string 100 further into the formation 105 (FIG. 1) by rotating, thereby allowing the cutting elements 306 to dig into and degrade the formation 105. The jack element 201 may assist in advancing the drill string 100 further into the formation 105 by oscillating back and forth with respect to the formation 105.

In some embodiments the jack element 201 has a primary deflecting surface 1001 disposed on a distal end 330 of the jack element 201. The deflecting surface 1001 may form an angle 332 relative to a central axis 307 of the jack element 201 of 3 to 75 degrees. The primary deflecting surface may cause the distal end to be asymmetric. The angle 332 may create a directional bias in the jack element 201. The deflecting surface 1001 of the jack element 201 may cause the drill bit 104 to drill substantially in a direction indicated by the directional bias of the jack element 201. By controlling the orientation of the deflecting surface 1001 in relation to the drill bit 104, the direction of drilling may be controlled. In some drilling applications, the drill bit 104, when desired, may drill 3 to 20 degrees per 100 feet drilled. In some embodiments, the jack element 201 may be used to steer the drill string 104 in a straight trajectory if the formation 105 comprises characteristics that tend to steer the drill string 104 in an opposing direction.

The primary deflecting surface 1001 of the jack element 201 has a surface area of 0.5 to 4 square inches. The primary surface 1001 may have a radius of curvature of 0.75 to 1.25 inches. The jack element 201 may have a diameter of 0.5 to 1 inch, and may be made of carbide. The distal end 330 of the jack element 201 may have rounded edges so that stresses exerted on the distal end 330 may be efficiently distributed rather than being concentrated on corners and edges.

The jack element 201 may be supported by a bushing 314 and/or bearing and may be in communication with another bearing 334. The bushing 314 may be placed between the jack element 201 and the drill bit body 304 in order to allow for low-friction rotation of the jack element 201 with respect to the drill string 100. The bushing 314 may be beneficial in allowing the jack element 201 to be rotationally isolated from the drill bit body 304. Thus, during a drilling operation, the jack element 201 may steer the drill string 100 as the drill bit body 304 rotates around the jack element 201. The jack element 201 may be driven by the motor 203 (FIG. 2) to rotate in a direction opposite to the rotation of the drill string 100.

In some embodiments two position feedback sensors 308 and 313 are disposed proximate the tool string component 301. A first sensor 308 is disposed proximate a coupler 310 on a gear train side 311 of the coupler 310. A drive shaft 309 may rotationally couple the jack element 201 to the coupler 310 and may be disposed intermediate the motor 203 and the jack element 201. The coupler 310 may connect the gear train 209 that is disposed intermediate the motor 203 and the drive shaft 309 to the drive shaft 309. A bearing 312 facilitates rotation of the coupler 310 with respect to the drill string 100.

A second sensor 313 may be disposed proximate the jack element 201 in the drive shaft 309. Both the first sensor 308 and the second sensor 313 may be embodiments of a position feedback sensors. In some embodiments a plurality of position feedback sensors disposed proximate the tool string component 301 may all be first sensors 308, or they may all be second sensors 313. In other embodiments a drill string 100 may comprise no more than one position feedback sensor like sensor 308 or sensor 313.

The drive shaft 309 has a first portion 401 secured within the bore 324 of the tool string component 301. A second portion 402 of the drive shaft 309 is secured within the bore 325 of the drill bit 104. The first and second portions 401, 402 may be made of material selected from the group consisting of cemented metal carbide, steel, manganese, nickel, chromium, titanium, or combinations thereof.

The first and second portions 401, 402 of the drive shaft 309 are connected by box 404 and pin connection 403. The box and pin connection 403 may be adapted such that the first and second portions 401 and 402 respectively are automatically connected as the tool string component 301 is mechanically coupled to the drill bit 104. The first portion 401 may include the box 404; and the second portion 402 may included the pin 405 or vise versa. A sleeve 406 may be used to form the box 404 in the box and pin connection 403.

Figure 5:
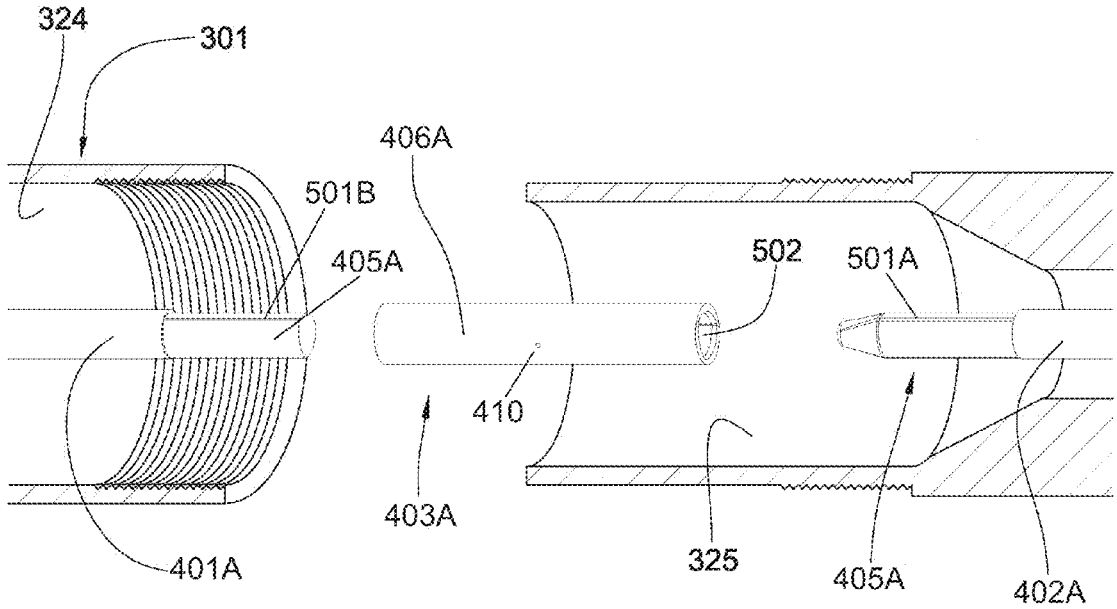
FIG. 5 is a perspective diagram of another embodiment of a section of a drill string.
Figure 6:
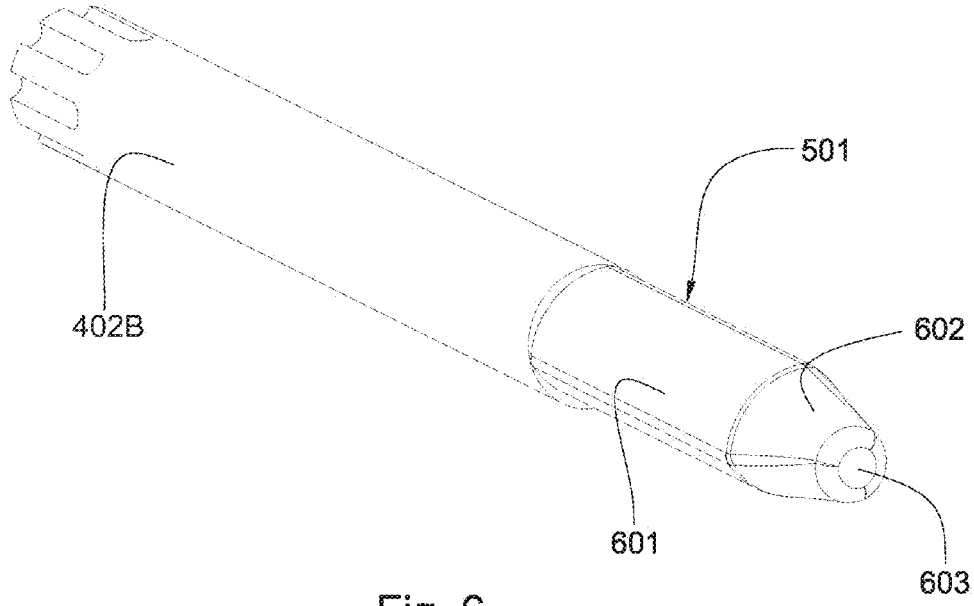
FIG. 6 is a perspective diagram of an embodiment of a drive shaft portion

Referring now to FIGS. 5 through 6, the first and second portions 401A, and 402A have at least one external torque transferring feature 501, such as a spline. The box 404 (FIG. 3) or sleeve 406A of the pin connection 403A of FIG. 5 may have an internal opening 502 adapted to interlock with the at least one external torque transferring feature 405A and 405B of the first and second portions 401A and 402A. As the first portion 401A of the drive shaft 309 is rotated, it is believed that the at least one external feature like external feature 50A and 501B will allow torque to be transferred from the first portion 401A to the second portion 402A of the shaft 309.

The at least one feature 501 may include shapes with surfaces to be polygonal 601 in section. In some embodiments, the first and second portions 401A and 402A have may be shaped to have surfaces 601 to be a Reuleaux triangle in cross-section. The sleeve 406A of FIG. 5 has an internal opening 502 formed to mate with the surface 601 of the first and second portions 401A and 402B. The at least one feature 501 may have a length of 2.5 to 3.75 inches. In some embodiments the at least one feature 501 has a length of 3 inches.

The second portion 402B of the shaft 309 in FIG. 6 may include a generally conical region 602. The generally conical region 602 may be formed such that the at least one feature 501 of the second portion 402B may converge into a point 603 of the conical region 602. It is believed that the generally conical region 602 will assist in guiding the second portion 402B of the drive shaft 309 as it is inserted into a sleeve like sleeve 406A or box 404 (FIG. 3) of the pin connection 403.

The first portion 401A in FIG. 5 may be press-fit to the inside of the sleeve 406A; and the second portion 402A may rest in the sleeve 406A. The second portion 402 A may be press-fit to the inside or opening 502 of the sleeve 406A; and the first portion 401A may rest in the sleeve 406B. Both the first and second portions 401A and 402A may be press-fit to the inside of the sleeve 406A. Both the first and second portions 401A and 402B may rest in the sleeve 406A. A hole 410 may be formed in the side of the sleeve 406A to allow air to exit the sleeve 406A as the first portion 401A and the second portion 402A are inserted into the sleeve 406A.

In some embodiments some or all of the features of the first portion 401A may be applied to the second portion 402A and in some embodiments, some or all of the features of the second 402A portion may be applied to the first portion 401A.

Figure 7:
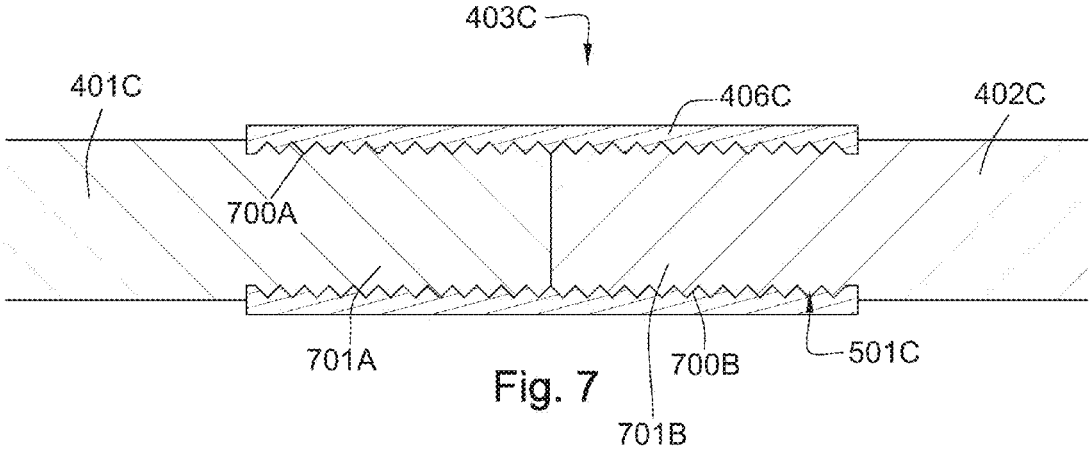
FIG. 7 is a perspective diagram of another embodiment of a drive shaft portion.

FIG. 7 discloses a connection wherein the first and second portions 401C and 402C have threads 700A and 700B as the at least one feature 501C. The sleeve 406C is internally threaded. The threads 700A of the first portion 401C may be right-handed; and the threads 700B of the second portion 402C may be left-handed, or vise versa. The inside of the sleeve 406C may have corresponding both right-handed and left-handed threads 700A and 700B. The threads 700A and 700B may cause the first and second portions 401C and 402C to have a reduced diameter portion 701A and 701B at the connection. It is believed that the reduced diameter 701A and 701B of the first and second portions 401A, 402B at the pin connection 403C may prevent the sleeve 406C from wandering away from the connection 403.

Figure 8:
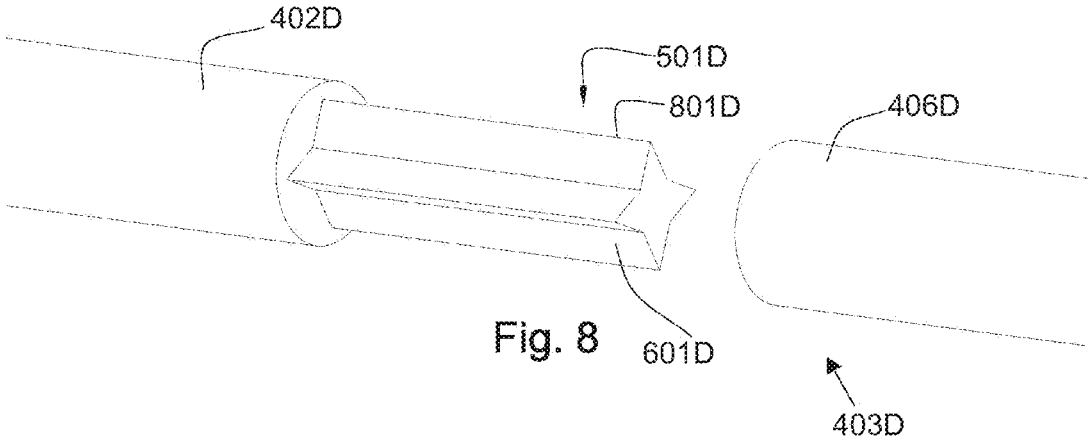
FIG. 8 is a perspective diagram of another embodiment of a drive shaft portion
Figure 9:
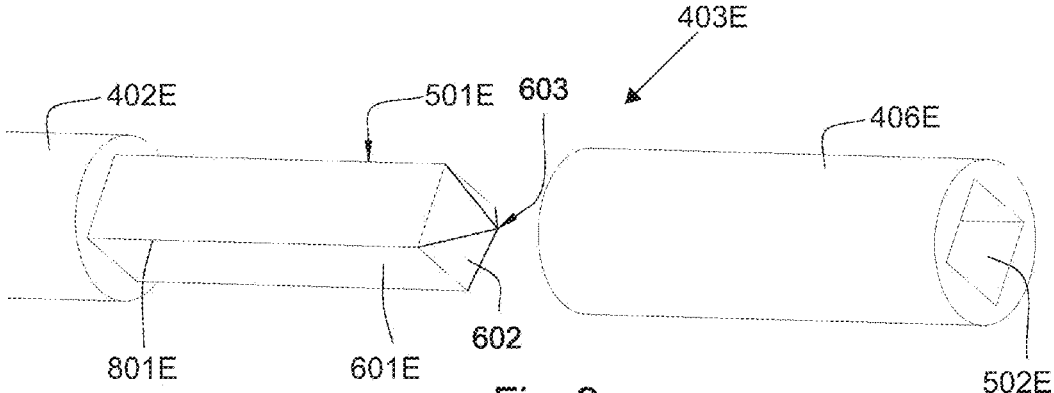
FIG. 9 is a perspective diagram of another embodiment of a drive shaft portion.

FIGS. 8 through 9 disclose more embodiments for connecting portions of shaft 309 like portion 402D and 402E to a sleeve like sleeves 406D and 406E. The portions 402D and 402E have the at least one feature 501D and 501E which here are surfaces 601D and 601E that are polygonal in section. The surface 601D may be star-shaped in section; and the surface 601E is square shaped in section and sized to register with opening 502E. The surfaces 601D and 601E may also be shaped to be in section one of but not limited to, triangles, rectangles, pentagons, hexagons, heptagons, octagons, or combinations thereof. The edges 801D and 801E of the surfaces 601D and 601E may be rounded so as to reduce wear and stress buildup in the connection 403D and 403E. The surface 601E has a pyramid formation 602 at its end with a tip 603.

Figure 10:
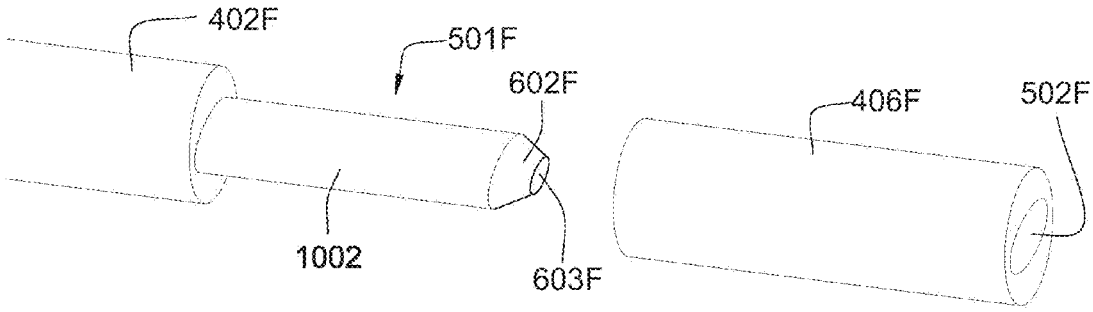
FIG. 10 is a perspective diagram of another embodiment of a drive shaft portion

The at least one feature 501F may be an to be elliptical surface 1002 in section extending from the portion 402F of shaft 309 as seen in the embodiment of FIG. 10. The elliptical surface 1002 has a conical end 602F with a truncated tip 603F for insertion into the opening 502F in sleeve 406F.

Figure 11:
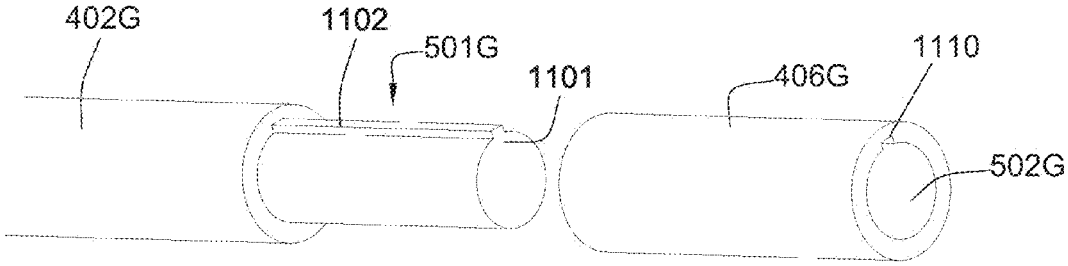
FIG. 11 is a perspective diagram of another embodiment of a drive shaft portion.

The at least one feature 501G of FIG. 11 shows the portion 402G of the shaft 309 having an end 1101 with a key 1102 sized to register with a slot 1110 in the opening 502G of the sleeve 406G. The key 1102 may also a bead, groove, notch, teeth, or combinations thereof with similar. The key 1102 is shaped to effectively lock the second portion 402G to the sleeve 406G.

Figure 12:
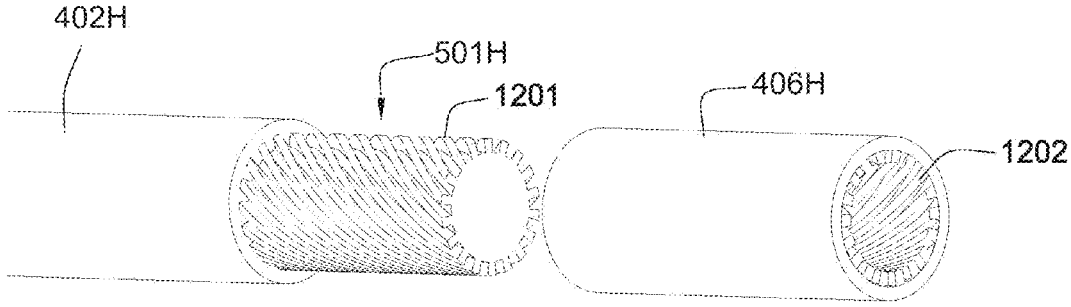
FIG. 12 is a perspective diagram of another embodiment of a drive shaft portion

Referring now to FIG. 12, the at least one feature 501H may comprise at least one spline 1201 formed at the end of portion 402H. The at least one spline 1201 may be selected from a group consisting of helical splines, straight splines or a combination thereof. The opening 1202 of the sleeve 406H may be internally splined to mate with the at least one spline 1201 of the second portion 402H.

Figure 13:
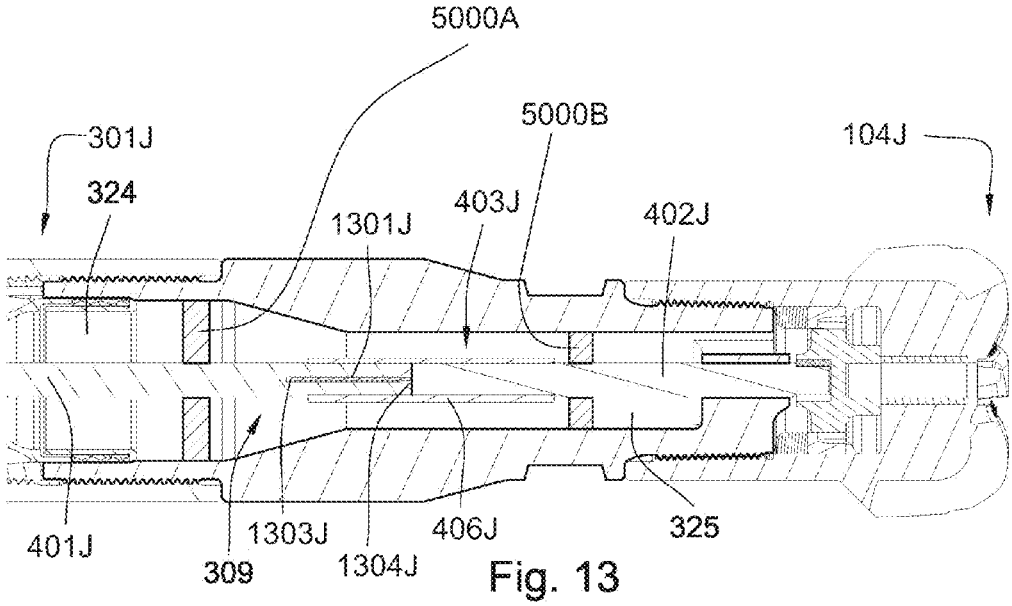
FIG. 13 is a perspective diagram of another embodiment of a section of a drill string.
Figure 14:
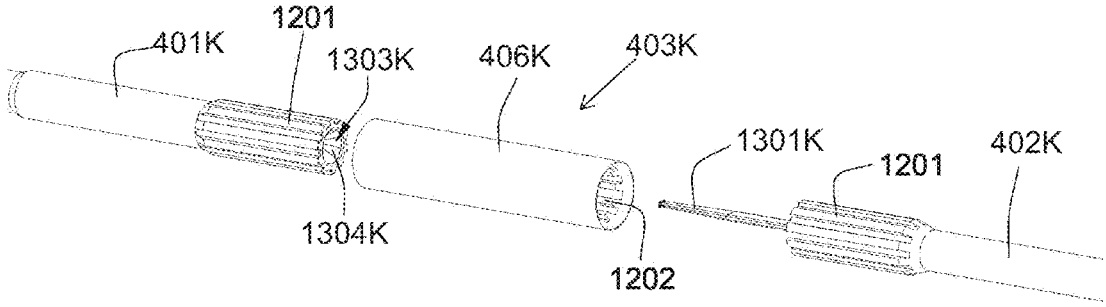
FIG. 14 is a perspective diagram of another embodiment of a drive shaft portion

FIGS. 13 though 14 disclose a pin connection 403J and 403K wherein the second portion 402J and 402K of the shaft 309 includes a guide 1301J and 1301K respectively. The guides 1301J and 1301K may be formed to have a shape of one of the group consisting of splines, keys, polygonal surfaces, elliptical surfaces, or combinations thereof. The first portions 401J and 401K may include a recess 1303J and 1303K adapted to receive their guides 1301J and 1301K. The recesses 1303J and 1303K have a tapered opening 1304J and 1304K that tapers into the recess 1303J and 1303K, respectively. The recesses 1303J and 1303K may be adapted to accommodate the shape of the guides 1301J and 1301K, respectively. It is believed that as the drill bit 104J is connected to the tool string component 301J, the tapered opening 1304J will direct the guide 1301J into the recess 1303J which will in turn guide the second portion 402J into the sleeve 406J causing the external features to align. Similarly for the embodiment of FIG. 14, it is believed that as the drill bit, like drill bit 104J, is connected to the tool string component, like component 301J, the tapered opening 1304K will direct the guide 1301K into the recess 1303K which will in turn guide the second portion 402K into the sleeve 406K causing the portions 401K and 402K to align. Also shown in FIG. 13 is at least one centering element 5000A and 5000B may be used to help keep one or both of the portions of the drive shaft 309 centered within the bore 324 and 325 of the downhole components.

Figure 15:
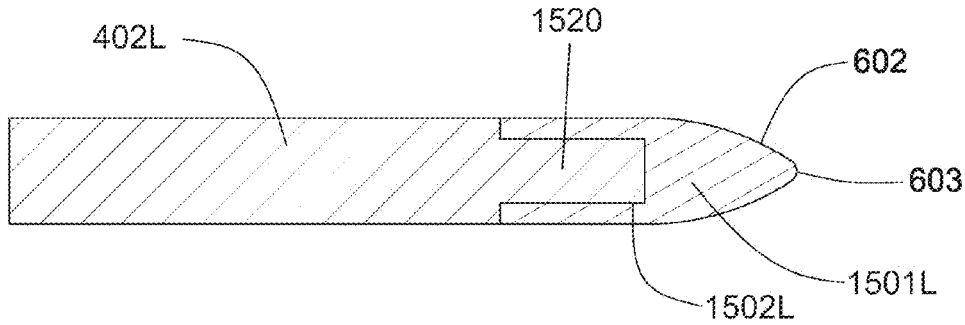
FIG. 15 is a perspective diagram of another embodiment of a drive shaft portion.
Figure 16:
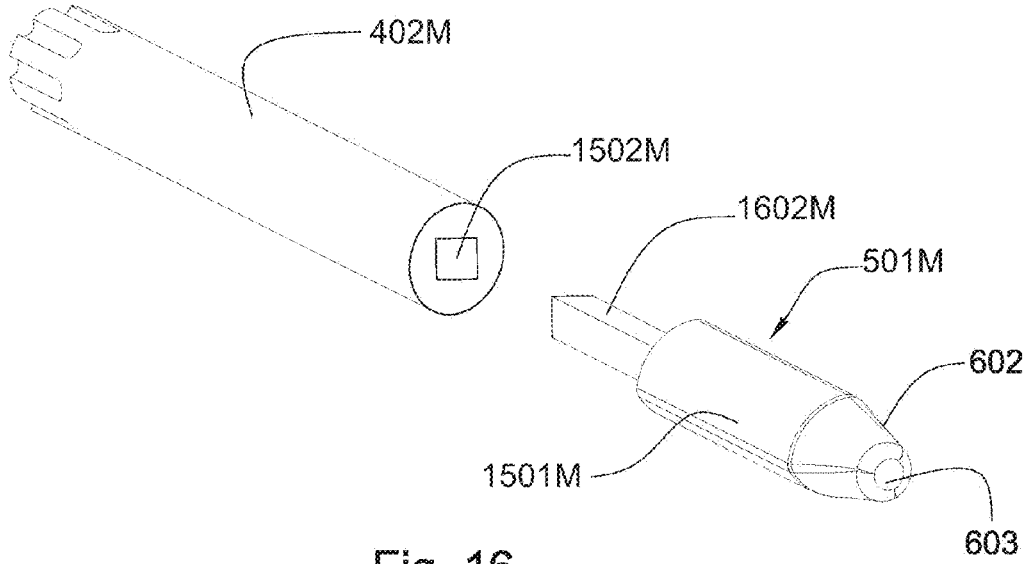
FIG. 16 is a perspective diagram of another embodiment of a drive shaft portion

FIGS. 15 through 16 disclose an embodiment wherein the second portions 402L and 402M have a cemented metal carbide distal ends 1501L and 1501M. The carbide distal ends 1501L and 1501M may include the at least one external torque transferring feature like feature 501M. The carbide distal ends 1501L may have a cavity 1502L. The cavity 1502L may be formed to receive a shank 1520 of the second portion 402L. The second portion 402L may be brazed or press-fitted within the cavity 1502L. The cavity 1502L may have a rectangular, elliptical, or polygonal geometry. It is believed that a rectangular, elliptical or polygonal geometry will help prevent the braze or press-fit between the cavity 1502L and the second portion 402L from failing in torque.

The cavity 1502M in FIG. 16 may be disposed in second portion 402M. The carbide distal end 1501M may include a shank 1602M. The shank 1602M may be shaped to fit within the cavity 1502M. The shank 1602M may be brazed or press-fitted within the cavity 1502 M. Both the shank 1602 M and the cavity 1502 M may be formed to be rectangular, elliptical, or in some other polygonal geometry to help prevent the braze or press-fit between the cavity 1502M and the shank 1602M from failing in torque.

Figure 17:
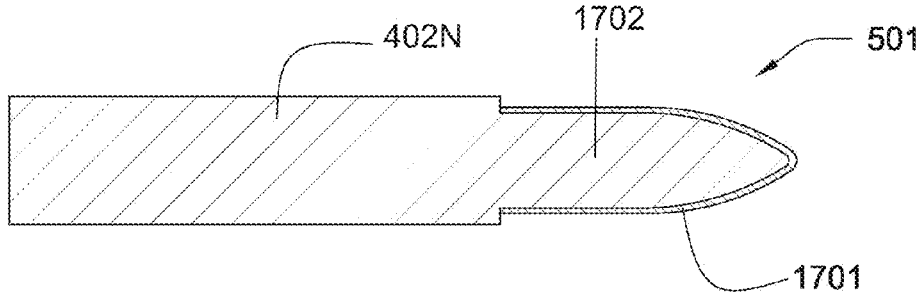
FIG. 17 is a perspective diagram of another embodiment of a drive shaft portion.

Referring now to FIG. 17, the second portions 402N may have a section 1702 formed for connection to a sleeve like sleeve 406. The portion 1702 has at least one coating 1701. The at least one coating 1701 may be made from a material selected from the group consisting of gold, silver, a refractory metal, carbide, tungsten carbide, cemented metal carbide, niobium, titanium, platinum, molybdenum, diamond, cobalt, nickel, Iron, cubic boron nitride, and combinations thereof.

Whereas the present invention has been described in particular relation to the drawings attached hereto, it should be understood that other and further modifications apart from those shown or suggested herein, may be made within the scope and spirit of the present invention.

What is claimed is:

1. A section of a drill string comprising:

a drill string component positioned in said drill string, said drill string component having a component bore;

a power source positioned in said drill string component and configured to supply rotary power;

a drill bit with a body between a shank and a working face, said drill bit having a body bore formed in said body, and said drill bit shank being connectable to said drill string component to receive rotational torque for drilling into a formation;

at least one cutting element attached to said drill bit proximate said working face;

a jack element having a proximal end opposite a distal end, said proximal end being disposed within the drill bit body, said jack element being substantially cylindrical and sized to have said distal end extend outwardly beyond said working face and said distal end being formed to be asymmetric;

a drive shaft having a first portion and a second portion, said first portion being connected to said power source to receive rotary power therefrom and sized to extend from said power source into said component bore, and said second portion being in communication with the jack element and extending into said body bore; and, a connector to effect a mechanical connection between said first portion and said second portion to transmit rotary power from said power source through said drive shaft to said jack element to rotate said jack element relative to the drill bit body to maintain said jack element in a desired position.

2. The section of claim 1, wherein the connection includes a sleeve, wherein said first portion has a connector end for insertion into said sleeve and wherein said second portion has a connector end for insertion into said sleeve.

3. The section of claim 2, wherein connector end of both said first portion and said second portion has at least one external feature and wherein said sleeve has an opening configured to register with said at least one external feature to effect a rotational connection between said first portion and said second portion through said sleeve.

4. The section of claim 3, wherein the at least one feature is selected from the group consisting of a spline, threads, a slot and key, and polygonal surfaces.

5. The section of claim 2, wherein the connector end of one of said first portion and said second portion has a guide.

6. The section of claim 5, wherein the connector end of the other of said first portion and said second portion has a bore sized and shaped to receive said guide.

7. The drill string of claim 6, wherein the guide is formed to be one of the group consisting of a spline, a slot and key, polygonal surfaces and elliptical surfaces.

8. The section of claim 2, wherein the connector end of both said first portion and said second portion are press-fit into the sleeve.

9. The section of claim 2, wherein the connector portion of one of said first portion and said second portion has conical part extending therefrom and where the other of said first portion and said second portion has an opening sized to receive said conical part.

10. The section of claim 2, wherein connector portion of one of said first portion and said second portion of the drive shaft has a centering element.

11. The section of claim 2, wherein said jack element has a central axis and wherein said jack element has a tip at said distal end which is displaced from said central axis.

12. The section of claim 11, wherein said jack element is truncated with an essentially flat surface intersecting said central axis proximate said tip and at an angle relative to said central axis.

13. The section of claim 1, wherein the connection is a pin at one end of one of the first portion and the second portion and a box at one end of the other of the first portion and the second portion, said pin and said box being sized and configured to effect a mechanical connection for rotation of said drive shaft and said jack element.

14. The section of claim 13, wherein the pin and box are sized to effect a press-fit.

15. The section of claim 1, wherein the said jack element has an axis and a surface at an angle relative to said axis.

16. The section of claim 1, wherein the first portion and said second portions are made of a material selected from the group consisting of cemented metal carbide, steel, manganese, nickel, chromium and titanium.

17. A section of a drill string comprising:

a drill string component positioned in said drill string, said drill string component having a component bore;

a power source positioned in said drill string component and configured to supply rotary power;

a drill bit with a body between a shank and a working face, said drill bit having a body bore formed in said body, and said drill bit shank being connectable to said drill string component to receive rotational torque for drilling into a formation;

at least one cutting element attached to said drill bit proximate said working face;

a jack element having a proximal end opposite a distal end, said proximal end being disposed within the drill bit body, said jack element being sized to have said distal end extend outwardly beyond said working face and said distal end being formed to be asymmetric;

a drive shaft having a first portion and a second portion, said first portion being connected to said power source to receive rotary power therefrom and sized to extend from said power source into said component bore, and said second portion being in communication with the jack element and extending into said body bore; and a connector to effect a mechanical connection between said first portion and said second portion to transmit oscillating power and rotary power from said power source through said drive shaft to said jack element to rotate said jack element relative to the drill bit body to maintain said jack element in a desired position.

* * * * *